US005254010A

United States Patent [19]

Davis

[11] Patent Number: 5,254,010

[45] Date of Patent: Oct. 19, 1993

[54] SECURING A SURFACE MOUNT ELECTRICAL CONNECTOR IN A METAL SHIELDING SHELL

[75] Inventor: Wayne S. Davis, Harrisburg, Pa.

[73] Assignee: AMP Incorporated, Harrisburg, Pa.

[21] Appl. No.: 945,798

[22] Filed: Sep. 16, 1992

[51] Int. Cl.[5] ..... H01R 13/648

[52] U.S. Cl. ..... 439/108; 439/609

[58] Field of Search ..... 439/83, 108, 607, 609

[56] References Cited

U.S. PATENT DOCUMENTS

| | | | |
|---|---|---|---|
| 4,637,669 | 1/1987 | Tajima | 339/14 R |
| 4,842,555 | 6/1989 | Cosmos et al. | 439/609 |
| 4,990,094 | 2/1991 | Chandler et al. | 439/108 |
| 5,017,156 | 5/1991 | Sugiyama | 439/607 |
| 5,017,158 | 5/1991 | Liu et al. | 439/609 |
| 5,055,070 | 10/1991 | Plegge et al. | 439/609 |

*Primary Examiner*—Eugene F. Desmond

[57] ABSTRACT

A folded sheet metal shielding shell (4) for a surface mounted electrical connector (6) has first and second side walls (12, 14), the first side wall (12) extending rearwardly of the second side wall (14). A cantilever flange (46) depends from a top wall (8) of the shell (4) and is formed with a latching opening (52) for latchingly receiving a wedge shaped latch member (86) on a side face of the housing (70) of connector (6). The flange (46) provides a rearward extension of the second side wall (14) and is connected to the top wall (8) so as to be deflectable away from the first side wall (12) to allow the latch member (86) to engage in the latching opening (52) with a snap action, and resiles when the latch member (86) has engaged in the latching opening (52).

12 Claims, 6 Drawing Sheets

SECURING A SURFACE MOUNT ELECTRICAL CONNECTOR IN A METAL SHIELDING SHELL

BACKGROUND OF THE INVENTION

This invention relates to a folded sheet metal shielding shell for an electrical connector for surface mounting on a circuit board and to an assembly comprising the connector and the shielding shell in combination. The invention particularly concerns means for securing the connector in the shell upon its insertion thereinto.

U.S. Pat. No. 5,017,156 discloses a folded sheet metal shielding shell in which an electrical connector for surface mounting on a circuit board is secured by means of pawls projecting from edge portions of a seam in a bottom wall of the shell and which engage in an opening in the dielectric housing of the connector, and by means of a rear wall of the shell, which is bent down against the rear of the connector when it has been inserted into the shielding shell. A mounting foot for connection to ground projects from a bottom edge of each side wall of the shielding shell.

According to U.S. Pat. No. 4,637,669 a folded sheet metal shielding shell, which is open at both ends is secured about an electrical connector for surface mounting on a circuit board, by means of inward protrusions on opposite side walls of the shell, which protrusions engage between pawls on a terminal support of the connector and proximate walls of the terminal support. A bottom wall of the shielding shell has a mounting post bent downwardly therefrom.

There is disclosed in U.S. Pat. No. 4,842,555, a folded sheet metal shielding shell for receiving an electrical connector for surface mounting on a circuit board. The connector is secured in the shell by means of inturned flanges depending from a top wall of the shielding shell and detents in side walls of the shell, which anchor the shell to the body of the connector. Mounting posts project from bottom edges of the side walls of the shielding shell.

The present invention is intended to provide a shielding shell for a surface mount electrical connector, into which shell the connector can readily be inserted without distortion of the shell side walls, so as to be secured in the shell with a snap action, minimal adaption of the housing of the connector being needed to achieve this end.

SUMMARY OF THE INVENTION

According to one aspect of the invention a folded sheet metal shielding shell for receiving an electrical connector for surface mounting on a circuit board, comprises; a top wall; a bottom wall for location proximate to a face of the circuit board when the connector is mounted thereon; and first and second side walls connected to the top and bottom walls to define in cooperation therewith a tubular enclosure having a forward open end for receiving a mating shield and an open rear end for receiving the connector.

The first side wall projects rearwardly beyond the second side wall and a cantilever flange connected to the top wall provides a rearward extension of the second side wall. The cantilever flange has formed therein a latching member in the connector and is resiliently deflectable away from the first side wall.

A mounting post depends from the cantilever flange below the bottom wall of the shell for connection to a grounding conductor on the circuit board.

The deflectability of the cantilever flange ensures that when the connector is inserted into the shielding shell by way of its open rear end, the latching member of the connector can engage in the latching opening of the cantilever flange with a snap action without distortion of the side walls of the shielding shell and that the connector can readily be inserted into the shell.

A tongue may extend from the cantilever flange under the bottom wall of the shell to assist in guiding the cantilever flange during its deflection and subsequent resiling movement. Conveniently the mounting post may depend from a cross-piece which is connected to the tongue and the flange, the cross-piece having been bent up to lie in a complementary cut out in the cantilever flange.

Where the second side wall defines the seam of the folded shielding shell, which seam could open, for example, as a result of thermal changes, so as to allow the escape of electro-magnetic induction from the shell, when the connector is in use, the cantilever flange preferably overlaps the second side wall and thus the seam and cooperates with the tongue to restrain opening of the seam.

For additional security the cantilever flange and the first side wall may have rearwardly projecting tabs for bending in against the rear of the connector.

According to another aspect thereof the invention relates to a shielded electrical connector assembly comprising the shielding shell with the connector latched therein by means of the cantilever flange and the latch member.

DETAILED DESCRIPTION OF THE EMBODIMENTS OF THE INVENTION

The first embodiment of the invention will now be described with reference to FIGS. 1 to 7. An electrical connector assembly 2 for mounting to a printed circuit board PCB, comprises an EMI metal shielding shell 4, and an electrical connector 6 received in the shell 4.

Figure 1:
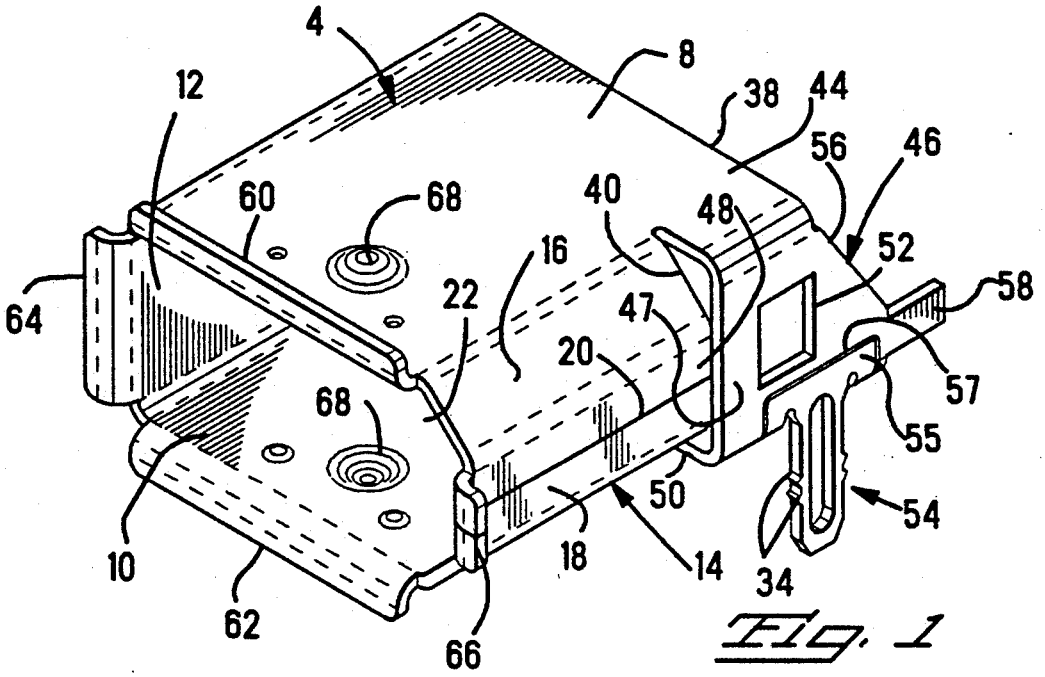
FIG. 1 is an isometric view of a metal shielding shell according to a first embodiment of the invention, for an electrical connector for surface mounting on a printed circuit board.
Figure 2:
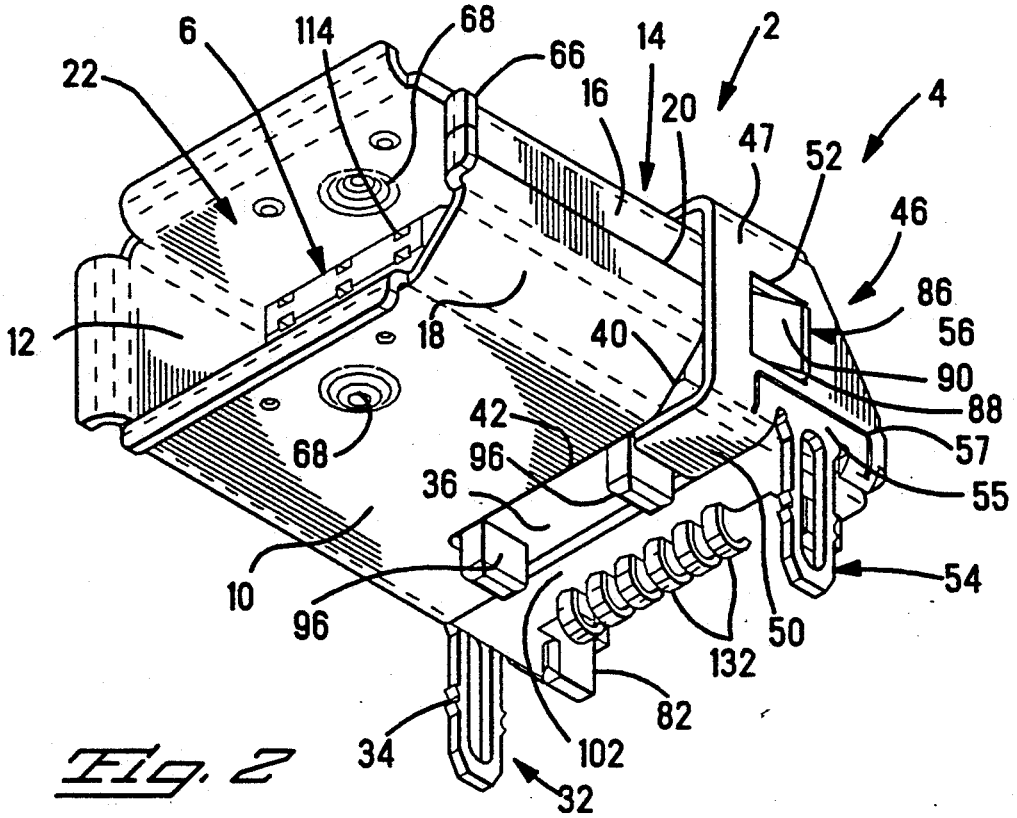
FIGS. 2 and 3 are, an isometric view taken from the front and an isometric view taken from the rear, respectively, of an electrical connector assembly comprising the connector with the shielding shell assembled thereto.

The shell 4 which was stamped, formed and folded up from a single piece of sheet metal stock provides a four sided, generally rectangular cross section tubular enclosure for the connector 6. The shell 4 comprises seamless planar top and bottom walls, 8 and 10, respectively, a planar seamless first side wall 12, and a second side wall 14. The side wall 14 comprises substantially identical upper and lower parts 16 and 18, respectively, cooperating to define a longitudinal seam 20, which was formed when the shell 4 was folded up. The side wall 14 is bowed outwardly of the shell 4. The shell 4 has an open forward end 22 and an open rear end 24. The side wall 12 extends over the full length of the shell 4 and has a rear edge 26 which projects rearwardly beyond the top wall 8 and is inclined downwardly and rearwardly therefrom. The side wall 12, at its bottom rear end, below the edge 26, a connector anchoring tab 28 which, before assembly of the shell 4 to the connector 6 projects rearwardly of the shell 4 in coplanar relationship with the side wall 12. The side wall 12 has formed therein, a substantially square latching opening 30 proximate to the rear edge 26. A mounting post 32 having lateral barbs 34 depends from a cross piece 33 received in a cut out 35 in the side wall 12, the crosspiece 33 being connected at each end to the bottom edge of the side wall 12. The mounting post 32 is located between the tab 28 and the opening 30. The bottom wall 10 of the shell 4 is formed with a rectangular, elongate, three sided cut out 36 positioned forwardly of the rear edge 33 of the top wall 8. The cut out 36 is open at its end remote from the side wall 12, proximate to the rear edge 40 of the side wall part 18. The cut out 36 has a forward edge 42. The top wall 8 has a rear portion 44 which projects laterally beyond the side wall 14 and from which depends at right angles to the top wall 8, a bent down planar flange 46 having a forward margin 47 overlapping a rearwardly extending margin 48 of the side wall 14 and thereby overlapping the rear end portion of the seam 20. There extends inwardly of the shell 4, from the bottom end of the flange 46, and normally thereof, a tongue 50 which projects beneath, and engages, the lower part 18 of the side wall 14. Rearwardly of its margin 47, the flange 46 is formed with a substantially square latching opening 52 which is aligned with the opening 30 in the side wall 12. A mounting post 54, which is identical with the mounting post 32 depends from a cross-piece 55 defined by a score line 57 in the flange 46. The score line 57 impedes the flow of molten solder from the post 32 to the remainder of the flange 46 and provides a solder stop off. The crosspiece 55 is connected at one end to the tongue 50 and its opposite end to the bottom edge of the flange 46. The flange 46 has a rear edge 56 sloping downwardly and rearwardly from the top wall portion 44 in alignment with the edge 26 of the side wall 12. There projects rearwardly from the flange 46, below its rear edge 56, a connector anchoring tab 58 which is opposite to the tab 28 of the side wall 12. As shown in FIG. 1 the tab 58 projects rearwardly from the side wall 46 in coplanar relationship therewith before the shell 4 is assembled to the connector 6. At their forward ends, the walls 8, 10, 12 and 14 of the shell 4 have outwardly turned guide flanges 60, 62, 64, and 66, respectively, for guiding the mating shield of a mating connector (not shown) into the shell 4. The seam 20 bisects the flange 66. Outwardly convex dimples are formed in the walls 8 and 10 of the shell for latching engagement with complimentary bosses of said shield of the mating connector. The connector 6 comprises a one-piece, molded, dielectric housing 70, having a body 72 in the form of a substantially rectangular flat block. Terminal protecting lugs 74 project rearwardly from opposite lateral edges of the body 72. Each lug 74 has a downwardly inclined rear face 76 the length and inclination of which are identical with those of the rear edge 26 of the side wall 12 and the rear edge 56 of the flange 46. From the bottom end of each rear face 76 of each lug 74, depends a vertical, rear, tab abutment surface 78. Each lug 74 has a flat bottom surface from the rear part of which depends a rear stand-off stub 82. Each of two flat, opposite outer faces 84 of the housing 70 is formed with a latch member 86 having a rear abutment shoulder 88 extending normally of the face 84 and a forward camming face 90 sloping forwardly from the shoulder 88 towards the face 84. The body 72 has a flat top face 92 and a flat bottom face 94 which is stepped slightly above the bottom faces 80 of the lugs 74. There depends from each end of the bottom face 94, a forward stand-off stub 96. The body 72 has forward face 98 and a rear face 100. There projects rearwardly form the lower part of the face 100, a terminal tail spacer comb 102 defining a single row of contact tail receiving notches 104. Upper and lower rows of terminal receiving, through cavities 106 and 107, respectively, open into both of the faces 98 and 100. There projects horizontally from the forward face 98, a terminal support plate 108, the upper surface of which is formed with an upper row of terminal receiving grooves 110 and the lower surface of which is formed with a row of lower terminal receiving grooves 112. Each groove 110 communicates with a respective cavity 106 and each groove 112 communicates with a respective cavity 107. Also, each of the grooves 110 and 112 communicates with a respective channel 114 opening into the forward end of the support plate 108.

Figure 4:
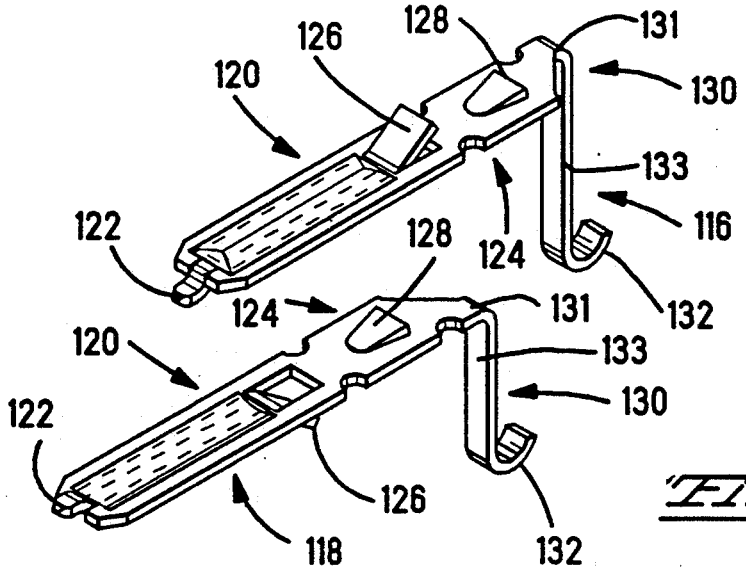
FIG. 4 is an isometric view showing two superposed electrical terminals of the connector.
Figure 5:
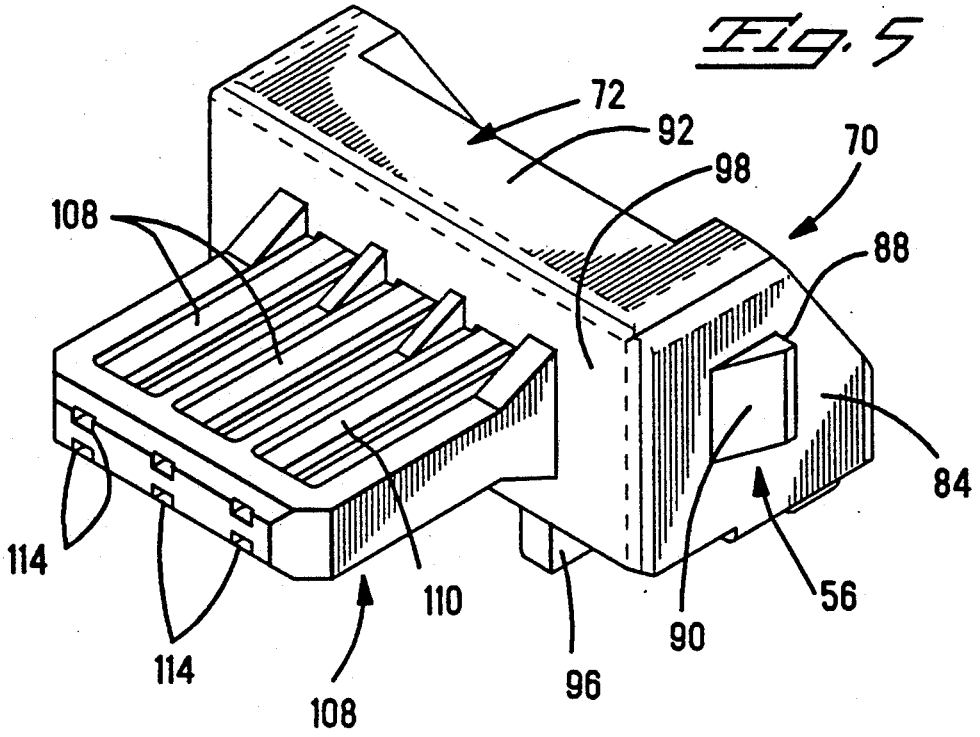
FIGS. 5 and 6 are an isometric view taken from the front and an isometric view taken from the rear, respectively, of an insulating housing of the connector.
Figure 6:
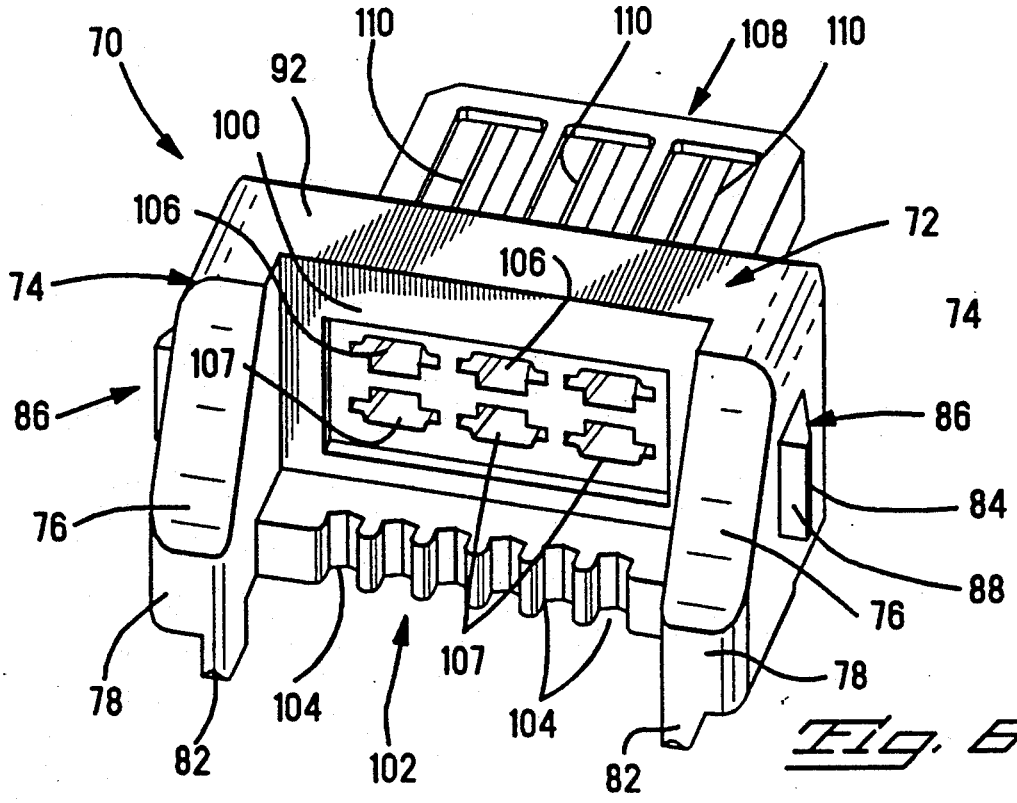

The connector 6 further comprises a plurality of upper and lower electrical terminals 116 and 118, respectively, which are best seen in FIG. 4. Each terminal 116 and 118 comprises a rectilinear mating portion 120 having a latching lip 122 at its forward end, an intermediate portion 124 formed with latching tongues 126 and 128, and a contact tail having a horizontal part 131 and a vertical part 133 depending from the part 131 and terminating in a solder foot 132. As will be best be apparent from FIG. 7, the mating portion 120 of each upper terminal 116, lies in a respective groove 110, with the intermediate portion 124 of the terminal in a respective cavity 106. The mating portion 120 of each lower terminal 118 lies in a respective groove 112 and the intermediate portion 124 of the terminal being received in a respective cavity 107. Each terminal 116 and 118 is held in position by the engagement of its latching lip 112 in a respective channel 114, the engagement of its latching tongue 126 against the forward face 98 of the body 72, and by the engagement of its latching tongue 128 against a shoulder located just forwardly of the rear face 100 of the body 72. The contact tails 130 of the terminals lie between the protective lugs 74 of the housing 70 with the parts 133 of the contact tails received in respective ones of the notches of the 104 of the comb 102 and with the solder feet 132 of the terminals below the bottom faces 80 of the lugs 74.

Figure 3:
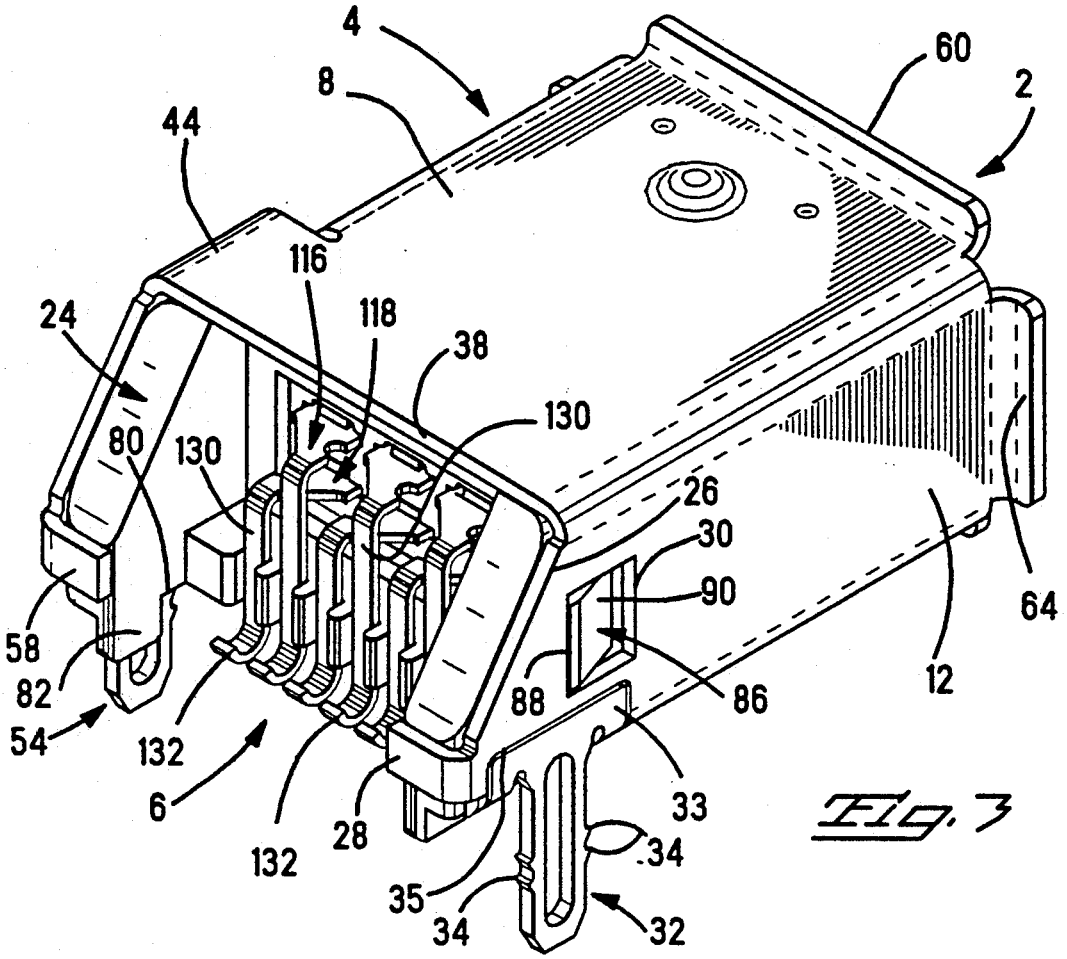

The connector 6 is assembled to the shielding shell 4, by inserting the connector 6, with its terminal support 108 leading, into the shell 4 through its open rear end 24, until each latch member 86 of the housing 70 is latchingly received in a respective latching opening 30 or 32 of the shell 4. During the insertion of the connector 6 into the shell 4, the camming faces 90 of the latch members 86 cam the flange 46 away from the tapered rear part of the side wall 12 of the shield 4, until the abutment shoulders 88 of the latch members 86 pass respective rear edges of the openings 52, whereby the flange 46 and the tapered rear part of the side wall 12 snap back into their initial positions so that the connector 6 is restrained from withdrawal form the shell 4. Forward movement of the connector 6 into the shell 4 is limited by the abutment of the spacer comb 102 against the rear edge of the tongue 50 and the rearmost edge of the bottom wall 10, as will best appear from FIG. 2. In the fully inserted position of the connector 6, the top face 92 and the bottom face 94 of the housing body 72 fit snugly against the inner surfaces of the top and bottom walls 8 and 10, respectively, of the shell 4. The connector 6 is further secured in the shell 4, by bending in the tabs 28 and 58 to engage against the abutment surfaces 78, of respective ones of the lugs 74 (FIG. 3).

Figure 7:
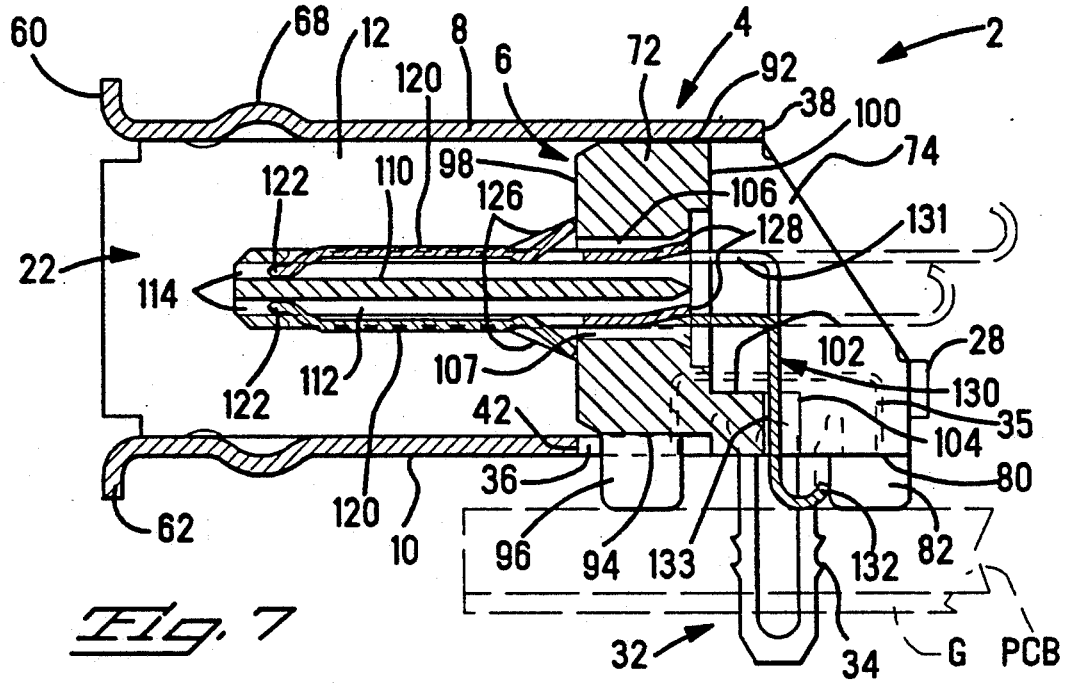
FIG. 7 is a longitudinal sectional view of the electrical connector assembly when mounted on the printed circuit board.

The finished assembly 2, thus provided, is surface mounted to the board PCB as shown diagrammatically in FIG. 7, with the mounting post 32 and 54 resiliently engaged, by virtue of longitudinal slots therein, in holes in the board PCB, the barbs 32 of the mounting posts securing them from withdrawal from the holes. The stubs 82 and 96 engage against the top face of the board PCB to stand it off therefrom, with the solder feet 132 of the terminals against printed conductors on the board PCB. With the assembly 2 so mounted on the board PCB, the solder feet 132 are soldered to the printed conductors, these being connected to electronic circuitry on the board PCB and the posts 32 and 54 are soldered to grounding conductors G on the board PCB.

When the connector 6 is mated with a mating shielded electrical connector on a further printed circuit board, and/or by reason of temperature changes, the seam 20 of the shell 4 will tend to open, although it is to some extent restrained from doing so by the engagement of the flange 46 and its tongue 50 with the side wall 14 of the shell 4. Since the seam 20 is defined by a side wall of the shell 4, electro-magnetic induction radiating from the connector 6 is not directed towards the board PCB so as to interfere with the electronic circuitry thereon.

The second embodiment of the invention will now be described with references to FIGS. 8 and 9 in which those parts which have already been described above with reference to FIGS. 1 to 7, bear the same reference numerals and parts which are similar thereto bear the same reference numerals but with the addition of a prime symbol.

Figure 8:
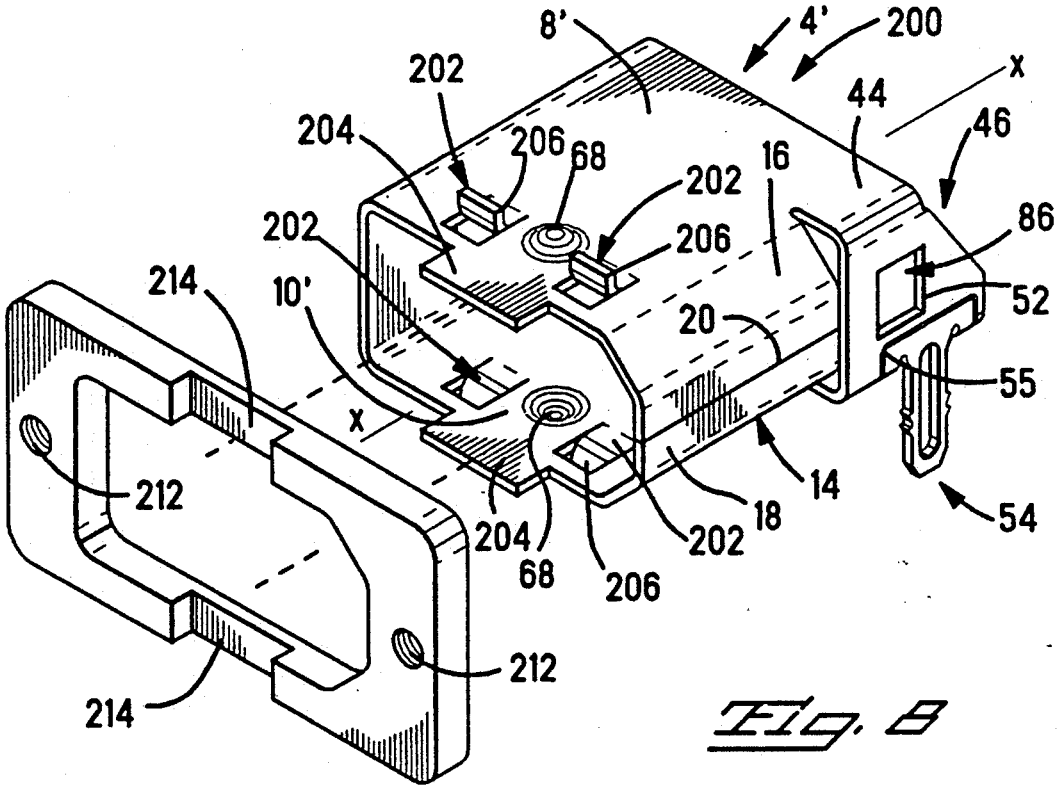
FIG. 8 is an isometric view of an electrical connector assembly having a shielding shell according to a second embodiment of the invention is association with a mounting flange for use in mounting the connector assembly to a mounting panel.
Figure 9:
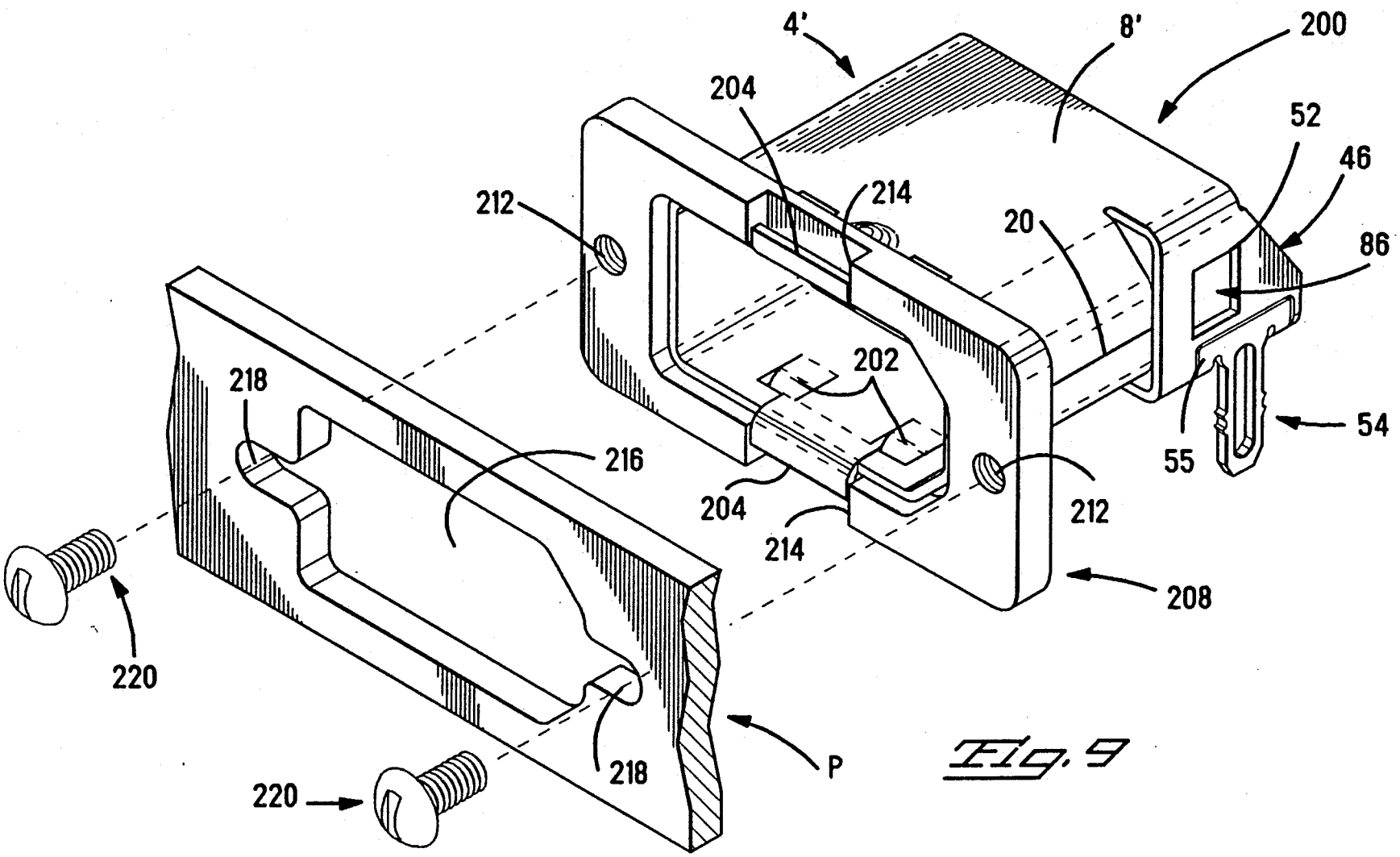
FIG. 9 is an isometric view showing the connector assembly of FIG. 8 assembled to the mounting flange, in association with the mounting panel.

The connector assembly 200 shown in FIGS. 8 and 9 differs from the connector assembly 2 in that it is for mounting to a metal panel P. To this end, the top wall 8' and the bottom wall 10' of the shell 4' are each formed with a pair of forwardly projecting tabs 204, the walls 8' and 10' also each being formed with pair of struck-out, resilient stops 202. The tabs 204 are bisected by the longitudinal axis X—X of the shell 4'. The stops 202 of each pair are equally spaced from that axis, each stop 202 of the top wall 8' being disposed opposite to a respective stop 202 of the bottom wall 10'. Each stop 202 has a forwardly bowed abutment surface 206 projecting away from the shell 4'. Each tab 204 is rectilinear and is coplanar, as shown in FIG. 8, with its respective wall of the shell 4' from which the tab 204 projects. The connector in this embodiment is identical with the connector 6 described above and is similarly assembled to its shielding shell.

The assembly 202 is provided with a stamped out metal flange 208 for attachment thereto, for mounting the assembly 2 to the panel P. The flange 208, which is in the form of a substantially rectangular flat plate, has a central cut-out 210 dimensioned snugly to receive the shell 4'. The flange 208 has a tapped, through hole 212 on each side of the cut out 210. The flange 208 also has a pair of opposed recesses 214 formed in its upper and lower margins, each opening into the cut-out 212 and into a respective edge of the flange 208.

The flange 208 is assembled to the shell 4' by inserting the latter, with the tabs 204 leading, through the cut-out 210 until the abutment surfaces 206 of the stops 202 engage the rear face of the flange 208. The tab 204 of the top wall 8' is then bent up into the upper recess 214, the tab 204 on the bottom wall 10' being bent down into the lower recess 214, as shown in FIG. 9. The flange 208 is thereby securely fastened to the shell 4' with the stops 202 resiliently engaging against the rear face of the flange 208. Since the shell 4' is snugly contained in the cut out 210, the seam 20 is maintained firmly closed. The connector 6 may be assembled to the shell 4' either before or after the latter has been assembled to the flange 208.

The panel P, which is shown only in fragmentary form, has a cut out 216 having opposed lateral extensions 218 for receiving respective bolts 220. In order to mount the connector assembly 200 to the panel P, the flange 208 on the assembly 200 is engaged against the rear face of the panel P with each of the tapped holes 212 of the flange 208 aligned with a respective extension 218 of the cut out 216 of the panel P. The bolts 220 are then screwed home into respective ones of the holes 212 until the heads of the bolts 220 tightly engaged the front face of the panel P. By virtue of the flange 208, the seam 20 cannot open at all by reason of temperature changes, and/or when the connector is mated with a mating connector. Only the two bolts 220 are required to mount multiple connectors, whereas, heretofore each connector requires its own fasteners to mount to the panel P and to a common mounting flange 208', FIG. 10.

Figure 10:
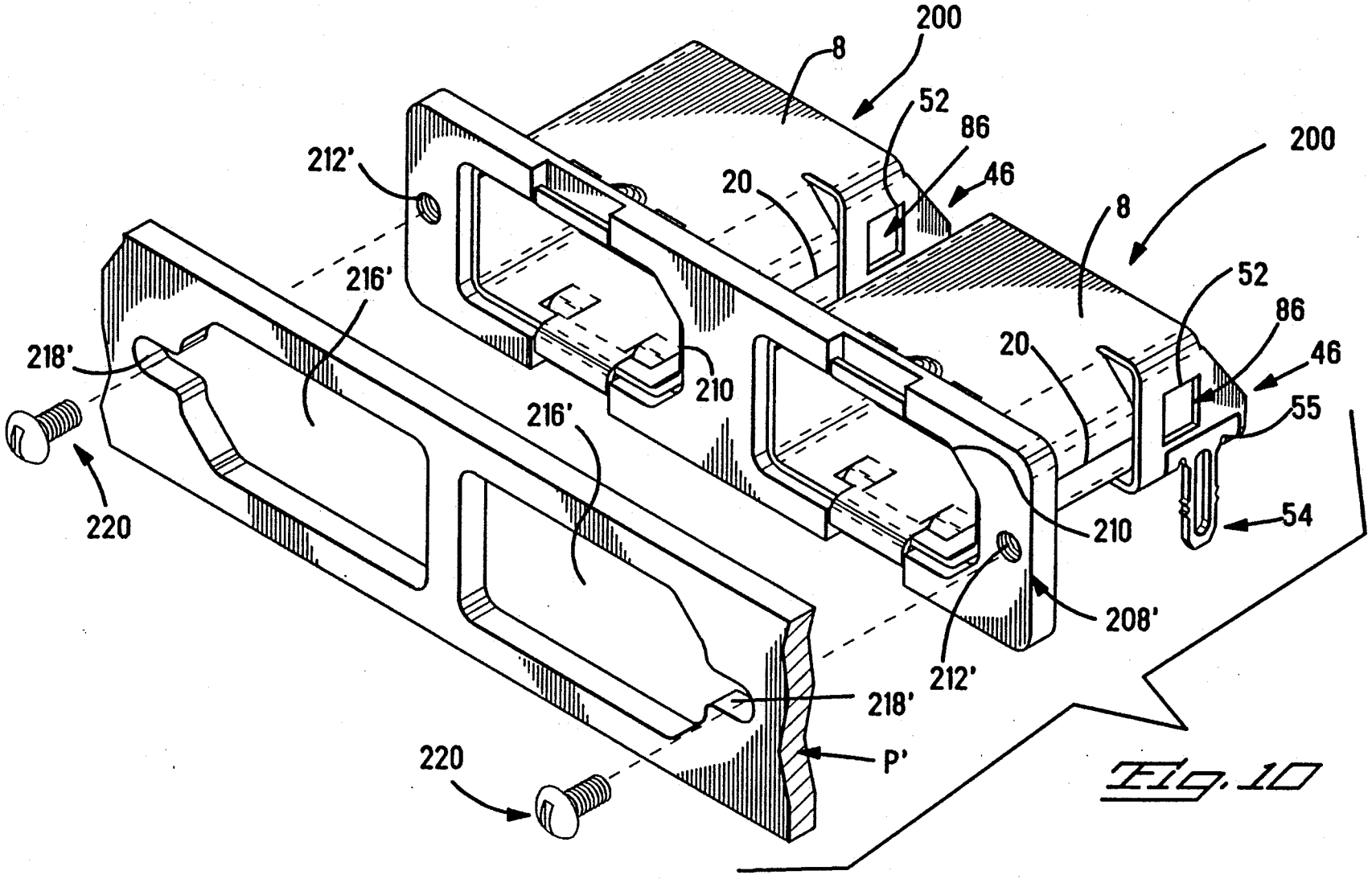
FIG. 10 is an isometric view showing two electrical connector assemblies according to FIG. 8 secured to a common mounting flange, in association with a further mounting panel.

As shown in FIG. 10 a plurality of connector assemblies 200 may be mounted in juxtaposed relationship to a common panel P' having a pair of juxtaposed cut outs 216' each having a lateral extension 218', these extensions being oppositely directed. In order to enable the assemblies 200 to be mounted to the panel P', they are secured to a common flange 208' having a pair of juxtaposed cut outs 210. Each assembly 200 is secured in a respective cut out 210 in the flange 208' in the manner described above with reference to FIG. 9. The flange 208' is engaged against the rear fact of the panel P' with each hole 212' in alignment with the extension 218 of a respective cut out 216' of the panel P' and bolts 220 are inserted through the extensions 218' and are screwed home into the tapped holes 212'.

The tabs 204, as well as serving to secure the shell 4' to the flange 208 or 208' also provide an electrical path through the shell and the flange to the metal panel. The tabs 204 that secure the shells 4' to the common flange 208' overlap sides of the respective cut outs except on sides of the cut outs that are between the electrical connectors to allow the electrical connectors in close proximity to one are then on the mounting flange.

What is claimed is:

1. A folded sheet metal shielding shell for receiving an electrical connector for surface mounting on a circuit board (PCB), the shielding shell comprising:

a top wall;

a bottom wall for location proximate to a face of the circuit board (PCB) when the connector is mounted thereon;

first and second side walls connected to the top and bottom walls to define in cooperation therewith a tubular enclosure having a forward open end for receiving a mating shield and an open rear end for receiving said connector, the first side wall extending rearwardly of the second side wall;

a cantilever flange connected to the top wall and providing a rearward extension of the second wall having formed therein a latching opening for latchingly receiving a latching member on the connector, said flange being resiliently deflectable away from the first side wall; and a mounting post depending from the cantilever flange below the bottom wall of the shell for connection to a grounding conductor (G) on the circuit board (PCB).

2. A shielding shell as claimed in claim 1, wherein a tongue projects from the cantilever flange beneath the bottom wall, the mounting post projecting from a cross piece defined by a score line solder stop off in the cantilever flange and having a first end formed integrally with the cantilever flange and a second and opposite end formed integrally with the tongue.

3. A shielding shell a claimed in claim 1, wherein the cantilever flange depends from the top wall in overlapping relationship with the second side wall, said first side wall being formed with a latching opening aligned with the latching opening of the cantilever flange, laterally of the shielding shell.

4. A shielding shell as claimed in claim 3, wherein each latching opening is rectangular and has a rearward latching edge.

5. A shielding shell as claimed in claim 1, wherein a first connector anchoring tab which is coplanar with the cantilever flange extends from a rear edge thereof; second connector anchoring tab extending from a rear edge of the first side wall in coplanar relationship therewith and in alignment with the first anchoring tab, laterally of the shielding shell.

6. A shielding shell as claimed in claim 1, wherein the second side wall defines a seam extending between a forward edge and a rear edge of the second side wall, the cantilever flange overlapping the seam, a tongue projecting from the bottom end of the cantilever flange engaging the bottom wall of the shielding shell.

7. A shielding shell as claimed in claim 6, wherein there project from forward edges of the top and bottom walls and of the side walls respective out turned flanges for guiding said mating shield into the shielding shell, the seam bisecting the out turned flange of the second side wall.

8. A shielded electrical connector assembly for surface mounting on a circuit board (PCB), the assembly comprising;

an electrical connector having a dielectric housing having a forward end and a rear end, opposite side faces, and a latch member projecting outwardly from each of said side faces, electrical terminals secured in the housing each having a mating portion projecting from the forward end of the housing and a contact tail depending from the rear end of the housing, each contact tail terminating in a foot for soldering a conductor on the circuit board (PCB); and a folded sheet metal shielding shell receiving the connector and having a forward open end and an open rear end, the shielding shell having a top wall, a bottom wall and first and second side walls connected to said top and bottom walls, the first side wall extending rearwardly beyond the second sidewall, a cantilever flange depending from the top wall and constituting a rearward extension of the second side wall being resiliently deflectable away from the first side wall and being formed with a first latching opening, a mounting post depending from the cantilever flange for connection to a grounding conductor (G) on the circuit board (PCB), the first side wall being formed with a second latching opening opposite to the first latching opening, the cantilever flange and the first side wall each being closely proximate to a respective one of the side faces of the connector housing and each latching member latchingly engaging in a respective one of said first and second latching openings.

9. An assembly as claimed in claim 8, wherein each latching member comprises a rear abutment shoulder overlapping a rear latching edge of said respective latching opening and a camming face sloping rearwardly from the rear abutment shoulder towards the respective side face of the connector housing.

10. An assembly as claimed in claim 9, wherein connector anchoring tabs project from rear edges of the cantilever and the first side wall of the shielding shell and engage against respective rear edges of the connector housing and thereby cooperate with the rear abutment shoulders of the latch members to secure the connector fixedly located in the shielding shell.

11. An assembly as claimed in claim 8, wherein terminal protection lugs extending rearwardly from the connector housing laterally enclose the contact tails of the terminals with the solder feet of the contact tails disposed below the protective lugs, rear end portions of the cantilever flange and of the first side wall, laterally enclosing the protective lugs.

12. An assembly as claimed in claim 11, wherein anchoring tabs on the cantilever flange and the first side wall extend laterally inwardly of the shielding shell and engage against flat, rearmost and lowermost end surfaces of the terminal protective lugs.

* * * * *